US006096262A

United States Patent [19]

Ueta et al.

[11] Patent Number: 6,096,262

[45] Date of Patent: Aug. 1, 2000

[54] MARTENSITIC HEAT RESISTING STEEL

[75] Inventors: Shigeki Ueta, Tokai; Toshiharu Noda, Tajimi; Michio Okabe, Chita, all of Japan

[73] Assignee: Daido Tokushuko Kabushiki Kaisha, Aichi-Prefecture, Japan

[21] Appl. No.: 09/304,991

[22] Filed: May 4, 1999

[30] Foreign Application Priority Data

May 12, 1998 [JP] Japan ..... 10-129337

[51] Int. Cl.[7] ..... C22C 38/22; C22C 38/00

[52] U.S. Cl. ..... 420/67; 420/42; 420/69; 420/105; 420/114; 148/325; 148/334; 148/333

[58] Field of Search ..... 420/67, 69, 42, 420/105, 114; 148/325, 334, 333

[56] References Cited

FOREIGN PATENT DOCUMENTS

| | | |
|---|---|---|
| 60-009860 | 1/1985 | Japan . |
| 60-116748 | 6/1985 | Japan . |
| 60-204837 | 10/1985 | Japan . |
| 94070369 | 9/1994 | Japan . |
| 407034204 | 2/1995 | Japan . |

*Primary Examiner*—Deborah Yee

*Attorney, Agent, or Firm*—Sughrue, Mion, Zinn, Macpeak & Seas, PLLC

[57] ABSTRACT

A martensitic heat resisting steel having improved heat resistance, which consists by weight percentage of 0.35%≦C≦0.60%, 1.0%≦Si≦2.5%, 0.1%≦Mn<1.5%, 7.5%≦Cr≦13.0%, one or both of 1.0%≦Mo≦3.0% and 1.0%≦W≦3.0% so that 1.5%≦(Mo+0.5W)≦3.0%, optionally 0.1%≦Nb+Ta≦1.0%, 0.1%≦V≦1.0% and S≦0.1%, and the remainder is substantially Fe.

8 Claims, 1 Drawing Sheet

MARTENSITIC HEAT RESISTING STEEL

BACKGROUND OF THE INVENTION

1. Field of the Invention

This invention relates to improvement in martensitic heat resisting steels and includes heat resisting machine parts manufactured by using the heat resisting steels.

2. Description of the Prior Art

The martensitic heat resisting steels are widely used as material for parts of the steam turbine, intake valves of the internal-combustion engine and so on. The martensitic heat resisting steels is moderate in price as compared with austenitic heat resisting steels and it is desirable to widely apply the martensitic heat resisting steels to the various machine parts to be used in high-temperature environment, however the martensitic heat resisting steels are apt to be tempered during the application at a high-temperature and the maximum working temperature is confined up to 600° C. approximately. Therefore, if the maximum working temperature can be improved, application of the martensitic heat resisting steels is enabled also in the field where the austenitic heat resisting steels have been used so far, and it is possible to reduce material cost of the machine parts.

SUMMARY OF THE INVENTION

The inventors have found that steels of which temper softening resistance is improved by adding a proper quantity of Mo, W, Nb+Ta, V and the like into base steels such as heat resisting steel SUH 11 or SUH 3 specified by JIS (these steels are preferably used for intake valves, high-temperature bolts or so) can stand the continuous application at 700° C. without losing the various original specificities of the steels. Furthermore it has been confirmed that carbides stable even in the high-temperature environment are formed by adding Nb+Ta, whereby coasening of crystal grains is inhibited at the time of hot forging and quench hardening and deterioration of toughness is prevented.

Therefore, it is an object to provide martensitic heat resisting steels of which maximum working temperature in the continuous application is raised up to 700° C. from 600° C. in the conventional steels by improving the heat resistance without losing the various specificities of the well-known martensitic heat resisting steels on basis of the aforementioned new findings obtained by the inventors, and it is another object to replace some usage of the austenitic heat resisting steels by the martensitic heat resisting steels.

BRIEF DESCRIPTION OF THE DRAWINGS

A single FIGURE is a graph illustrating changes of hardness of heat resisting steels with time when the heat resisting steels according to this invention are held at 700° C. together with the conventional steel after subjecting them to quench-and-temper.

DETAILED DESCRIPTION OF THE INVENTION

Figure 1:
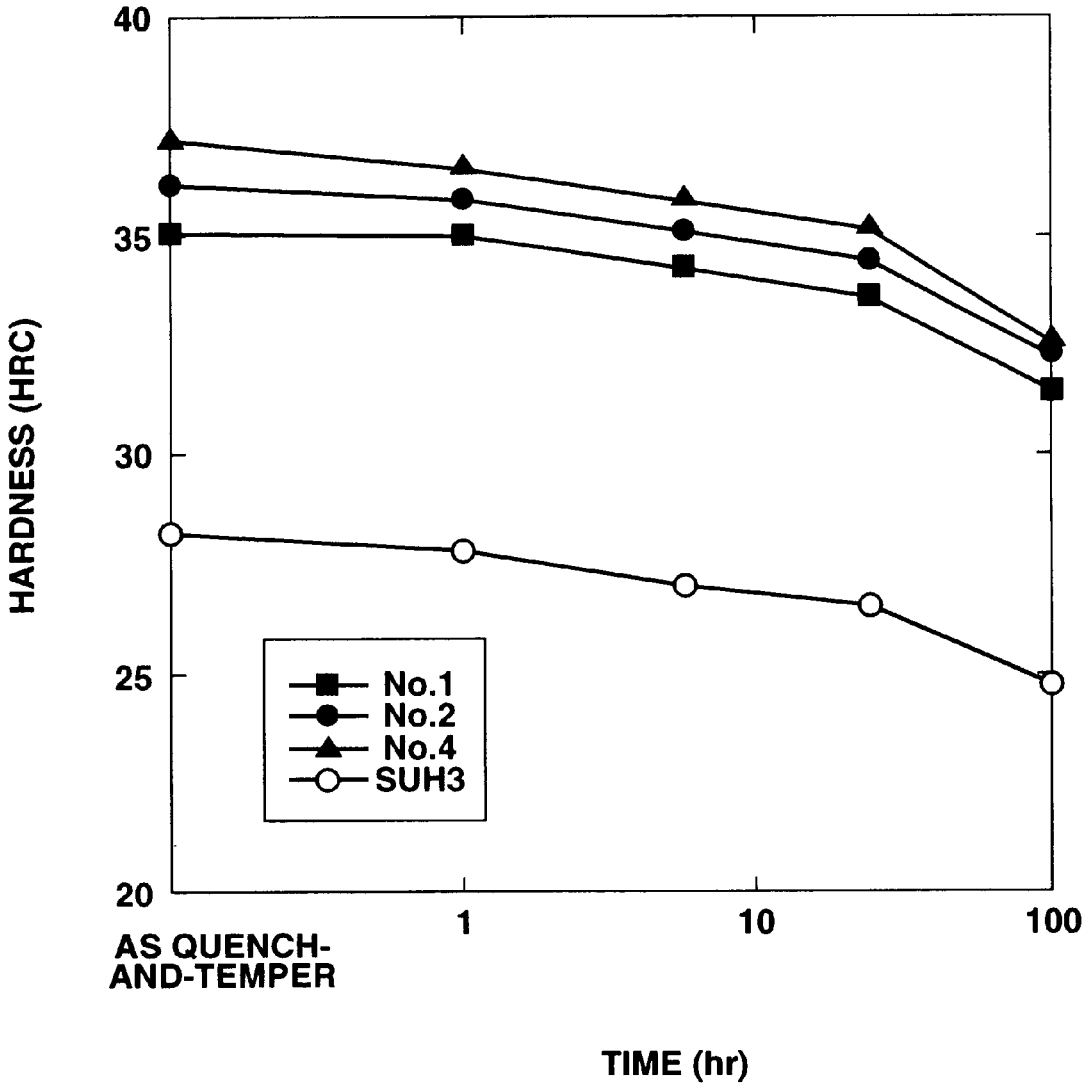

The martensitic heat resisting steel according to this invention has basically an alloying composition consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% Mo and 1.0 to 3.0% of W with the proviso that (Mo+0.5W) is in a range of 1.5 to 3.0% and the remainder being substantially Fe.

The heat resisting machine part of this invention is a product obtained from the heat resisting steel as raw material by forming the above-mentioned martensitic heat resisting steel into a desired shape of the machine part and subjecting it to quench-and-temper treatment, and maintains the hardness not lower than HRC 30 even after the continuous application at 700° C.

The martensitic heat resisting steel according to this invention may be contained with at least one element selected from the following group in addition to the above-mentioned basic alloying elements:

1) Nb+Ta: 0.1~1.0%,

2) V: 0.1~1.0%, and

3) S: not more than 0.1%

Respective functions and reasons of limitation of the aforementioned indispensable alloying elements and optional addition elements are as follows.

C: 0.35~0.60%

C is an indispensable element for ensuring the strength of a matrix of the steel after the quench-and-temper and for improving the high-temperature strength of the steel by forming carbides with Cr, Mo and W. It is necessary to add not less than 0.35% of C in order to certainly obtain such the effects. The toughness of the steel is degraded by excessive addition of C, so that the upper limit of C is defined as 0.60%.

Si: 1.0~2.5%

Si is helpful as a deoxidizer and effective to improve the oxidation resistance and the high-temperature strength, therefore Si is added in the relatively large amount of not less than 1.0%. Addition of Si is limited up to 2.5% since the toughness and the machinability are deteriorated if the amount of Si becomes excessive, however preferable Si content is in a range of 1.5 to 2.5%.

Mn: not less than 0.1% and less than 1.5%

Mn is useful as a deoxidizer and desulfurizing agent and contributes to increasing the strength of the steel by improving hardenability. It is necessary to add at least 0.1% of Mn, and required to select the amount less than 1.5%, preferably to add Mn in an amount up to 1.0%.

Cr: 7.5~13.0%

Cr is an indispensable element for heat resisting steels and helpful to improve the oxidation resistance, corrosion resistance and the high-temperature strength. It is necessary to add Cr in an amount of not less than 7.5% in order to obtain the above-mentioned effects in safe. The other side, the upper limit of the Cr content is defined as 13.0% because the toughness of the steel is degraded by the addition in a large amount.

Mo: 1.0~3.0%, W: 1.0~3.0% (one or both)

Mo+0.5W: 1.5~3.0%

Mo is effective not only to improve the hardenability, but also to improve the temper softening resistance and elevate A1 transformation point of the steel. Mo increases the high-temperature strength of the steel by forming carbides such as $M_7C_3$ or $M_2C$ type at the time of tempering. However, the steel loses its hot workability and oxidation resistance by adding Mo in a large amount, furthermore Mo is expensive.

W improves the hardenability and the temper softening resistance and elevates A1 transformation point similarly to Mo. Effects of W are the same as Mo in the point of improving the high-temperature strength by forming carbides of $M_7C_3$ or $M_2C$ type, and common to Mo in the point that the hot workability is damaged by addition in a large amount. For such the reasons, lower and upper limits of these elements are defined as 1.0% and 3.0%, respectively and the calculated value of Mo+0.5W is defined in the range of 1.5 to 3.0%.

The functions and reasons of limitation of the elements to be added optionally will be described below.

Nb+Ta: 0.1~1.0%

Nb and Ta form carbides (Nb,Ta) C and nitrides (Nb,Ta)N by combining with C and N in the steel, and contributes to improvement of the high-temperature strength. Addition of 0.1% in total of Nb and Ta is required in order to obtain the effect certainly. The carbides exist stably in the steel even at elevated temperatures and prevent the coarsening of crystal grains at the time of forging or heating for quench hardening. This is helpful to improve the toughness of the steel, but excessive addition of these elements is rather harmful to the toughness and deteriorates quenching hardness. Therefore, the upper limit of Nb and Ta in total is defined to 1.0%.

V: 0.1~1.0%

V has a function similar to that of Nb+Ta, and improves the high-temperature strength of the steel. Carbides VC are stable at elevated temperatures, and also prevent the coarsening of crystal grains of the steel at the time of forging or heating for quench hardening. There is the same phenomena that excessive addition of V is harmful to the toughness and deteriorates the quenching hardness of the steel. The lower limit of 0.1% and the upper limit of 1.0% are defined from the same viewpoint as that of Nb+Ta.

S: not more than 0.10%

S is effective element for improving the machinability of the steel, therefore it is recommendable to appropriately add in the steel according to the usage of the heat resisting steel. However, deterioration of the hot workability and the fatigue strength is caused by the excessive addition, and the addition of S must be selected in the amount of not more than threshold value of 0.10%.

EXAMPLES

Each of martensitic heat resisting steels having a chemical composition shown in Table 1 was melted in a high frequency induction furnace, and then cast to obtain an ingot.

TABLE 1

| No. | | C | Si | Mn | Cr | Mo | W | Nb + Ta | V | S |
|---|---|---|---|---|---|---|---|---|---|---|
| Inventive example | 1 | 0.42 | 1.88 | 0.54 | 8.62 | 1.97 | — | — | — | — |
| | 2 | 0.46 | 2.03 | 0.69 | 11.21 | 1.05 | 2.12 | — | — | — |
| | 3 | 0.45 | 2.00 | 0.81 | 10.97 | 1.01 | 2.08 | — | — | 0.05 |
| | 4 | 0.50 | 2.15 | 0.62 | 9.06 | 2.24 | | 0.27 | — | — |
| | 5 | 0.41 | 1.99 | 0.53 | 8.84 | 1.28 | 1.85 | — | 0.22 | — |
| | 6 | 0.53 | 1.72 | 0.81 | 12.10 | 1.57 | 1.29 | 0.16 | — | — |
| | 7 | 0.39 | 2.08 | 0.77 | 10.76 | 2.32 | 1.04 | — | 0.13 | — |
| | 8 | 0.56 | 1.93 | 0.60 | 8.48 | 1.81 | 2.35 | 0.16 | 0.10 | — |
| | 9 | 0.44 | 2.07 | 0.98 | 8.45 | 1.66 | 1.21 | 0.19 | — | 0.06 |
| | 10 | 0.48 | 1.75 | 0.62 | 10.73 | 1.57 | 1.34 | 0.13 | 0.08 | 0.04 |
| Comparative example | SUH 3 | 0.39 | 1.92 | 0.56 | 10.34 | 0.88 | — | — | — | — |
| | SUH 11 | 0.51 | 1.78 | 0.52 | 7.73 | — | — | — | — | — |

Each of obtained ingots was maintained at 1150° C. for 3 hours, and successively formed into a round bar of 16 mm in diameter by forging and rolling at a temperature range of 1150~950° C. The obtained bar was quenched into oil after heating at 1050° C. for 30 minutes and tempered by air cooling after heating at 750° C. for an hour. Test pieces were cut out from the respective round bar subjected to the heat treatment, and various specificities of the respective steel were evaluated through the following testing methods.

<Hardness after tempering>

Rockwell hardness was measured at a room temperature using a test piece with a diameter of 16 mm and a thickness of 10 mm cut out from the respective round bar.

<High-temperature hardness>

Vickers hardness was measured at 700° C. using a high-temperature hardness specimen with a diameter of 10 mm and a thickness of 5.5 mm cut out from the respective round bar.

<High-temperature tensile strength>

The tensile strength, elongation and reduction of area were measured through the high-temperature tensile test at 700° C. using a tensile test specimen specified in JIS as No.4 cut out from the respective round bar.

<Fatigue test>

Fatigue strength of $10^7$ times was measured at 700° C. using a rotary bending fatigue test specimen with a diameter of 6 mm cut out from the respective round bar.

<Oxidation resistance>

An oxidation specimen with a diameter of 7 mm and a length of 15 mm was cut out from the respective round bar, and oxidation loss was measured after maintaining the specimen in an oven at 700° C. for 50 hours.

<Machinability>

A tool life was compared with respect to the heat resisting steel of inventive examples Nos. 3, 9 and 10, and a comparative example SUH 3 by cutting the steels into bolts.

Results obtained through the aforementioned tests are shown in Table 2 concerning the hardness after tempering and the high-temperature hardness, and in Table 3 concerning the high-temperature tensile strength, fatigue strength, oxidation resistance and machinability. The machinability is expressed in values relative to data obtained concerning the comparative example SUH 3 which is represented with "1.0" for convenience.

TABLE 2

| No. | | Hardness (R.T) after tempering at 750° C. (HRC) | High-temperature hardness at 700° C. (HV) |
|---|---|---|---|
| Inventive example | 1 | 35.3 | 244 |
| | 2 | 36.1 | 253 |
| | 3 | 35.9 | 246 |
| | 4 | 37.0 | 259 |
| | 5 | 35.2 | 242 |
| | 6 | 37.8 | 266 |
| | 7 | 35.2 | 238 |

TABLE 2-continued

| No. | | Hardness (R.T) after tempering at 750° C. (HRC) | High-temperature hardness at 700° C. (HV) |
|---|---|---|---|
| | 8 | 38.1 | 270 |
| | 9 | 35.7 | 247 |
| | 10 | 36.4 | 255 |
| Comparative example | SUH 3 | 28.2 | 203 |
| | SUH 11 | 24.8 | 171 |

TABLE 3

| No. | | Tensile properties at 700° C. T.S (MPa) | E1 (%) | R.A (%) | Fatigue strength of $10^7$ times at 700° C. (MPa) | Oxitation loss after heating at 700° C. for 50 hours ($mg/cm^2$) | Machinability (Tool life) |
|---|---|---|---|---|---|---|---|
| Inventive example | 1 | 321 | 40 | 83 | 167 | 0.22 | |
| | 2 | 336 | 38 | 80 | 172 | 0.18 | |
| | 3 | 328 | 39 | 81 | 162 | 0.30 | 1.8 |
| | 4 | 340 | 37 | 80 | 172 | 0.24 | |
| | 5 | 319 | 42 | 85 | 172 | 0.16 | |
| | 6 | 347 | 39 | 81 | 176 | 0.13 | |
| | 7 | 315 | 45 | 87 | 172 | 0.17 | |
| | 8 | 348 | 36 | 78 | 176 | 0.20 | |
| | 9 | 324 | 41 | 84 | 167 | 0.21 | 1.9 |
| | 10 | 332 | 39 | 82 | 172 | 0.18 | 1.6 |
| Comparative example | SUH 3 | 208 | 52 | 93 | 137 | 0.14 | 1.0 |
| | SUH 11 | 183 | 64 | 96 | 137 | 0.20 | |

Furthermore, the test pieces of the inventive examples Nos.1, 2 and 4, and the comparative example SUH 3 are subjected to the quench-and-temper treatment under the aforementioned condition, and then changes of the hardness of the respective test pieces were observed by holding the test pieces at 700° C. for 100 hours in order to confirm the temper softening resistance of the steels. Obtained results are shown in FIG. 1.

It is apparent from the aforementioned data that the martensitic heat resisting steels according to this invention were excellent in the hardness after tempering, the high-temperature hardness, the fatigue strength and the tensile strength as compared with the well-known materials, and resist to the continuous application at a high-temperature. Furthermore, it may safely be said that the steels of this invention is not inferior to the conventional steels also in the ductility and the oxidation resistance. The steels having the alloying composition effective to the machinability can be machined easily as compared with the existing steels.

As mentioned above, the heat resisting steel according to this invention has succeeded in improving the heat resistance without losing the various specificities of the already-existing martensitic heat resisting steel and raising the maximum working temperature of 600° C. in a case of continuous application of the conventional steel up to 700° C. The material cost increased along with this improvement is a negligibly little, and so the economically advantageous position of the martensitic heat resisting steel is not lost against the austenitic heat resisting steel according to this improvement. Accordingly, this invention contributes to enlarging the application field of the martensitic heat resisting steel.

What is claimed is:

1. A martensitic heat resisting steel consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% of Mo and 1.0 to 3.0% of W with the proviso that (Mo+0.5W) is in a range of 1.5 to 3.0%, and the remainder being substantially Fe.

2. A martensitic heat resisting steel consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% of Mo and 1.0 to 3.0% of W with the proviso that (Mo+0.5W) is in a range of 1.5 to 3.0%, 0.1 to 1.0% in total of Nb and Ta, and the remainder being substantially Fe.

3. A martensitic heat resisting steel consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% of Mo and 1.0 to 3.0% of W with the proviso that (Mo+0.5W) is in a range of 1.5 to 3.0%, 0.1 to 1.0% of V, and the remainder being substantially Fe.

4. A martensitic heat resisting steel consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% of Mo and 1.0 to 3.0% of W with the proviso that (Mo+0.5W) is in a range of 1.5 to 3.0%, 0.1 to 1.0% in total of Nb and Ta, 0.1 to 1.0% of V, and the remainder being substantially Fe.

5. A martensitic heat resisting steel consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% of Mo and 1.0 to 3.0% of W with the proviso that (Mo+0.5W) is in a range of 1.5 to 3.0%, not more than 0.1% of S, and the remainder being substantially Fe.

6. A martensitic heat resisting steel consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% of Mo and 1.0 to 3.0% of W with the proviso that (Mo+0.5W) is in a range of 1.5 to 3.0%, 0.1 to 1.0% in total of Nb and Ta, not more than 0.1% of S, and the remainder being substantially Fe.

7. A martensitic heat resisting steel consisting by weight percentage of 0.35 to 0.60% of C, 1.0 to 2.5% of Si, not less than 0.1% and less than 1.5% of Mn, 7.5 to 13.0% of Cr, one or both of 1.0 to 3.0% of Mo and 1.0 to 3.0% of W with the proviso that (Mo+0.5W) is in a range of 1.5 to 3.0%, 0.1 to 1.0% in total of Nb and Ta, 0.1 to 1.0% of V, not more than 0.1% of S, and the remainder being substantially Fe.

8. A heat resisting machine part formed from the martensitic heat resisting steel according to any one of claims 1 to 7 through quench-and-temper treatment and having a hardness of HRC 30 or above even after continuous use for 100 hours at a temperature of 700° C.

* * * * *